US010399353B2

(12) United States Patent
Sato et al.

(10) Patent No.: US 10,399,353 B2
(45) Date of Patent: Sep. 3, 2019

(54) VALVE UNIT AND LIQUID EJECTING APPARATUS

(71) Applicant: SEIKO EPSON CORPORATION, Tokyo (JP)

(72) Inventors: Hisashi Sato, Shiojiri (JP); Masahiko Sato, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/983,318

(22) Filed: May 18, 2018

(65) Prior Publication Data

US 2018/0333960 A1 Nov. 22, 2018

(30) Foreign Application Priority Data

May 22, 2017 (JP) ..... 2017-100657

(51) Int. Cl.
*B41J 2/175* (2006.01)

(52) U.S. Cl.
CPC ..... *B41J 2/17596* (2013.01); *B41J 2/175* (2013.01); *B41J 2/17509* (2013.01)

(58) Field of Classification Search
CPC ..... B41J 2/17596; B41J 2/175; B41J 2/17509
See application file for complete search history.

(56) References Cited

U.S. PATENT DOCUMENTS

| | | | | |
|---|---|---|---|---|
| 6,170,939 | B1 * | 1/2001 | Ujita | B41J 2/17513 347/86 |
| 9,688,077 | B1 * | 6/2017 | Kaneko | B41J 2/04588 |
| 9,855,755 | B2 * | 1/2018 | Kawate | B41J 2/17509 |
| 10,215,193 | B2 * | 2/2019 | Scovell | F04D 27/0215 |
| 2016/0023464 | A1 | 6/2016 | Nakao et al. | |
| 2017/0057242 | A1 | 3/2017 | Ueda | |

FOREIGN PATENT DOCUMENTS

| | | | |
|---|---|---|---|
| JP | 2011-051271 | A | 3/2011 |
| JP | 2011-194606 | A | 10/2011 |
| JP | 2016-022704 | A | 2/2016 |
| JP | 5946945 | B | 6/2016 |

* cited by examiner

*Primary Examiner* — Lamson D Nguyen
(74) *Attorney, Agent, or Firm* — Workman Nydegger

(57) ABSTRACT

A valve unit includes a valve seat that has a hole provided therethrough, the hole serving as part of a flow path, and a valve body that moves in a first direction relative to the valve seat. In the valve unit, the valve body includes a first portion that opens/closes the hole in collaboration with the valve seat, a second portion that is located inside the hole when viewed in the first direction, and a third portion that is located between the first portion and the second portion in the first direction and is located inside the hole while the hole is closed by the first portion. When viewed in the first direction, a gap between the hole and the third portion is larger than a gap between the hole and the second portion.

20 Claims, 7 Drawing Sheets

VALVE UNIT AND LIQUID EJECTING APPARATUS

CROSS-REFERENCE TO RELATED APPLICATIONS

This application claims priority to Japanese Patent Application No. 2017-100657 filed on May 22, 2017. The entire disclosure of Japanese Patent Application No. 2017-100657 is incorporated herein by reference.

BACKGROUND

1. Technical Field

The present invention relates to a valve unit used for a liquid ejecting apparatus such as, for example, an ink jet recording apparatus, and to a liquid ejecting apparatus. More particularly, the invention relates to a valve unit that can be stably operated and to a liquid ejecting apparatus.

2. Related Art

A liquid ejecting apparatus may include a valve unit that is disposed in a flow path extending from a liquid-supplying member to nozzles of a liquid ejecting head and that opens/closes the flow path. For example, an ink jet recording apparatus disclosed in JP-A-2016-022704 includes a valve seat through which a communication hole (communication opening) serving as part of a flow path is formed, and a valve body that moves forward/backward with respect to the valve seat. The ink jet recording apparatus is formed such that the valve body is brought into contact with the valve seat and thereby opens/closes the communication hole (liquid flow path). The valve body includes a shaft section that extends in a direction in which the valve body moves forward/backward when opening/closing the valve. The shaft section, which is inserted into the communication hole, guides the valve body so that the valve body does not incline relative to the valve seat. Moreover, in the configuration disclosed in the JP-A-2016-022704, in order to suppress deterioration of sealing that is caused by the accumulation of ink solute on an area of the valve seat with which the valve body comes into contact (an area sealed by the valve seat), a spacer (contact member) consisting of a hard member such as a metal plate, for example, is disposed on the area of the valve seat with which the valve body comes into contact. The spacer has an opening so as to be in communication with the communication hole. In addition, liquid-repellency treatment is applied to the surface of the spacer, which further reduces ink accumulation.

In such a valve unit, if the valve body is displaced relative to the valve seat (the position of the valve seat changes in a direction intersecting the axial direction of the valve body), the shaft of the valve body may interfere with the valve seat, especially with an edge portion surrounding the opening of the communication hole or with the spacer, when opening/closing the valve. This may hamper smooth opening/closing of the valve body. Even if such displacement does not hamper opening/closing of the valve body, interference of the valve body with the valve seat may lead to deterioration in sealing ability, which is caused by gradual abrasion of the valve body or by inclining or displacement of the valve body relative to the valve seat during the course of the valve being repeatedly opened and closed. This makes it difficult for the valve to operate stably for a long period of time.

SUMMARY

An advantage of some aspects of the invention is that a valve unit that can be operated stably and a liquid ejecting apparatus are provided.

A valve unit according to an aspect of the invention includes a valve seat that has a hole provided therethrough, the hole serving as part of a flow path, and a valve body that moves in a first direction relative to the valve seat. The valve body includes a first portion that opens/closes the hole in collaboration with the valve seat, a second portion that is located inside the hole when viewed in the first direction, and a third portion that is located between the first portion and the second portion in the first direction and is located inside the hole while the hole is closed by the first portion. When viewed in the first direction, a gap between the hole and the third portion is larger than a gap between the hole and the second portion.

With this configuration, inclination or displacement of the valve body relative to the valve seat is suppressed due to guidance of the hole and the second portion that is positioned in the hole. The third portion is provided not near the second portion but near the first portion in the first direction. This forms a large gap between the valve body and the valve seat. The large gap functions as a relieving space, which reduces the likelihood of the valve body interfering with the valve seat, especially with the peripheral edge surrounding the opening of the hole while opening/closing of the valve body. This further reduces the likelihood of the valve body inclining or being displaced relative to the valve seat due to the interference between the valve body and the valve seat, which enables the valve body and the valve seat to open/close the hole smoothly. This also suppresses deterioration in durability of the valve body or the valve seat. As a result, the valve unit can be operated for a longer period of time. Note that "interference" as used herein does not include any contact, for the purpose of guiding, between the inner circumferential surface of the hole and the outer circumferential surface of the second portion.

In the valve unit, it is desirable that the first portion include an elastic member that opens/closes the hole by causing the elastic member to separate from, or come into contact with, the valve seat, a retaining portion on which the elastic member is disposed, and a narrow portion that is located between the retaining portion and the third portion in the first direction. The narrow portion preferably includes a portion that has a width in a second direction that intersects the first direction, the width being narrower than the third portion, and the narrow portion is surrounded by the elastic member that is mounted on the retaining portion.

According to this configuration, the narrow portion has a portion having a width smaller than the third portion. Thus, the narrow portion and the third portion forms a step portion therebetween, and the elastic member disposed around the narrow portion engages this step portion. This prevents the elastic member from being displaced, in other words, for example, from rising or being disengaged from the retaining portion. In addition, the narrow portion has a portion of which the thickness is smaller than that of the third portion. The contact area between the elastic member and the retaining portion increases as the thickness of the narrow portion becomes smaller. As a result, displacement of the elastic member relative to the retaining portion is suppressed more reliably.

In the valve unit, it is desirable that when viewed in the first direction, a gap between the second portion and the hole have a first width and a second width that is wider than the first width.

With this configuration, the position of the valve body can be regulated relative to the valve seat by the gap having the first gap width, which is narrower, while the gap having the second gap width, which is wider, allows liquid to flow smoothly through the hole.

In the valve unit, it is desirable that the second portion have a tapered shape, at an end opposite to the first portion in the first direction, in which thickness decreases as distance from the first portion increases.

With this configuration, providing the second portion with the tapered portion facilitates insertion of the second portion into the hole when mounting the valve body onto the valve seat, thereby improving work efficiency during assembly. This also reduces the likelihood of the second portion abrading the valve seat when opening/closing the valve, enabling the valve body to move smoothly relative to the valve seat. This contributes to stable operation of the valve unit.

In the valve unit, it is desirable that the valve seat include a hole member having the hole provided therethrough, and a contact member with which the valve body comes into contact during valve closure in which the hole is closed by the valve body. It is also desirable that the contact member have a portion with which the valve body comes into contact and liquid repellency of the portion be higher than liquid repellency of the hole member. It is also desirable that rigidity of the contact member be higher than rigidity of the hole member.

With this configuration, providing the valve unit with the contact member having a high liquid repellency reduces the likelihood of solute of liquid accumulating while the valve body comes into contact repeatedly. In addition, even if the contact member becomes out of exact alignment with the hole during manufacturing of the valve unit and thereby a portion of the contact member protrudes into the hole, the likelihood of the protruded portion interfering with the valve body is suppressed because of the third portion being provided in the valve body. This contributes to stable operation of the valve unit.

It is desirable that the valve unit further include an enlarged portion at an opening of the hole of the hole member, the opening being located near the contact member. It is also desirable that in the valve unit, the enlarged portion have an inner width larger than any other inner width of the hole in a second direction that intersects the first direction.

This reliably reduces the likelihood of the valve body interfering with the valve seat when the valve body opens/closes. In addition, the enlarged portion functions as a relieving space to accept residual adhesive when the contact member is adhered by using an adhesive to the area that surrounds the hole. Residual adhesive may escape from between the hole member and the contact member and may hamper liquid flow in the flow path or hamper opening/closing of the valve body, which can be effectively suppressed by this arrangement.

A liquid ejecting apparatus according to another aspect of the invention includes the valve unit having the above configurations and an ejection mechanism having nozzles that eject liquid supplied from the valve unit.

According to the invention, the liquid ejecting apparatus includes the valve unit that can be stably operated for a long period of time, which imparts a long-term reliability to the liquid ejecting apparatus.

BRIEF DESCRIPTION OF THE DRAWINGS

The invention will be described with reference to the accompanying drawings, wherein like numbers reference like elements.

DESCRIPTION OF EXEMPLARY EMBODIMENTS

Exemplary embodiments will be described with reference to the accompanying drawings. Note that although various limitations will be included in the description of exemplary embodiments to describe preferred examples, such particular cases should not be construed as limiting the scope of the invention unless explicitly stated otherwise. Also note that the following description is based, by way of example, on an ink jet type printer (hereinafter referred to as "printer") 1, which is a liquid ejecting apparatus having a valve unit according to the invention. Such an ink jet type printer includes an ink jet type recording head (hereinafter referred to as "recording head") 10, which is a type of liquid ejecting head, in other words, a type of ejection mechanism according to the invention.

Figure 1:
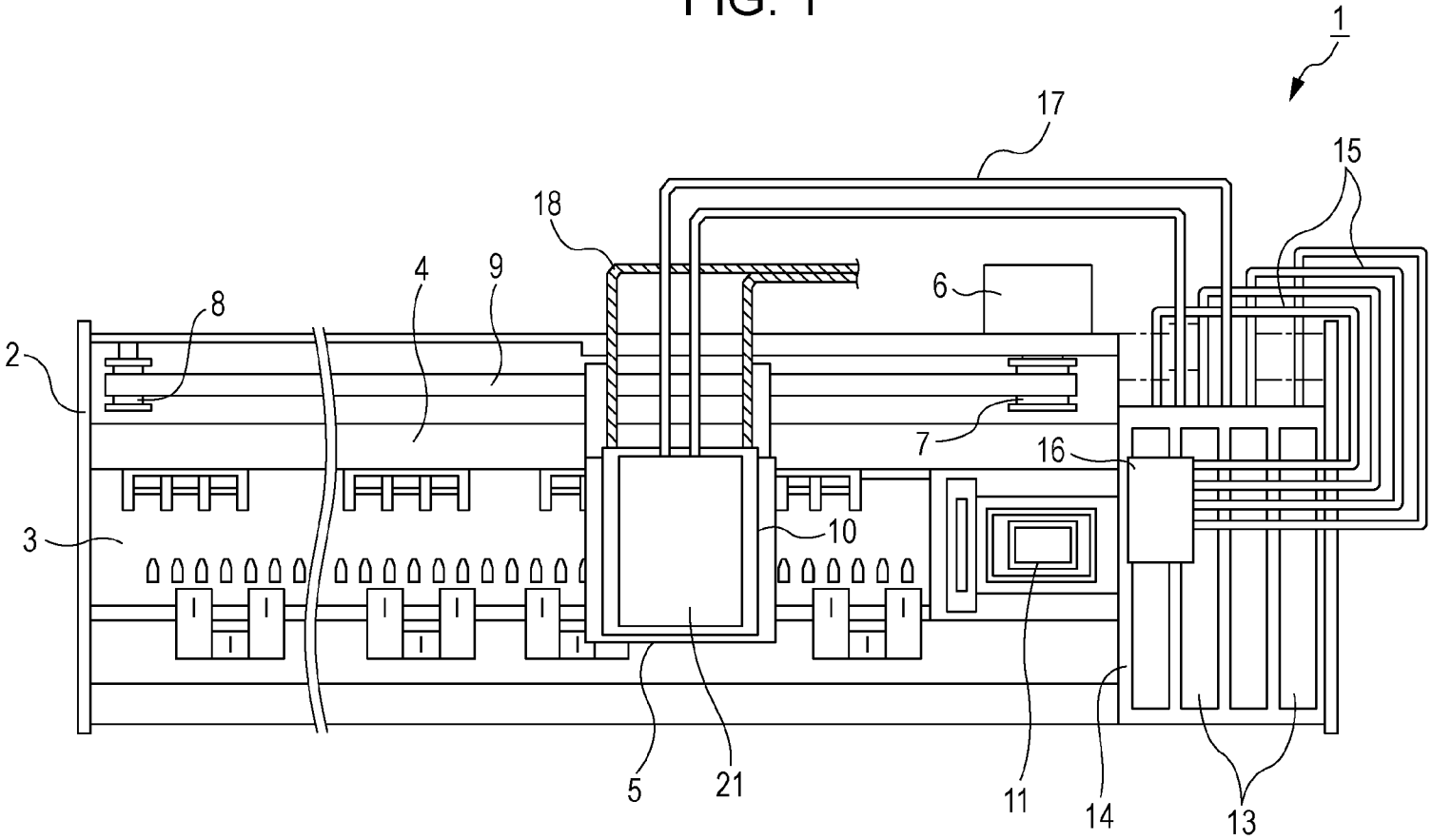
FIG. 1 is a plan view illustrating an example of a liquid ejecting apparatus.

FIG. 1 is a plan view illustrating a construction of a printer 1. The printer 1 according to the present embodiment is an apparatus that records images, text, or the like by ejecting liquid ink (a type of liquid according to the invention) from a recording head 10 (see FIG. 2, etc.) onto a surface of a recording medium (liquid-depositing target, not shown), such as a sheet of recording paper, a piece of cloth, or a piece of resin film. The printer 1 includes a frame 2, a platen 3 disposed within the frame 2, and a transport mechanism (not shown). The transport mechanism transports a recording medium onto the platen 3. Within the frame 2, a guide rod 4 extends parallel to the platen 3. The guide rod 4 slidably supports a carriage 5 that accommodates the recording head 10. The carriage 5 is formed such that a carriage-moving mechanism (not shown) causes the carriage 5 to move in a reciprocating manner along the guide rod 4 in the main scanning direction, which intersects the transport direction of a recording medium. The carriage-moving mechanism includes a pulse motor 6, a drive pulley 7 that rotates in response to actuation of the pulse motor 6, an idler pulley 8 disposed within the frame 2 on a side opposite to the drive pulley 7, and a timing belt 9 extending around the drive pulley 7 and the idler pulley 8. The printer 1 according to the embodiment performs recording by ejecting ink from nozzles 30 (see FIG. 2) of the recording head 10 while the carriage 5 moves reciprocally relative to a recording medium.

A cartridge holder 14 is provided in a side region within the frame 2. Ink cartridges 13 (a type of liquid supply source or liquid storage container) are detachably mounted on the cartridge holder 14. An air pump 16 is connected to the ink cartridges 13 via air tubes 15, and air from the air pump 16 is supplied into each of the ink cartridges 13. The pressurized air pressurizes the inside of each ink cartridge 13, and thereby the ink in the ink cartridge 13 is supplied (delivered under pressure) toward the recording head 10 via an ink supply tube 17. The ink delivered from each ink cartridge 13 via the ink supply tube 17 is first introduced into a valve unit 21, which is mounted on the carriage 5. The ink introduced into the valve unit 21 is subsequently supplied to an ink flow path within the recording head 10 after a supply pressure of the ink is regulated. Note that the liquid storage container is not limited to the ink cartridge 13 described above by way of example, but various types of constructions, such as a cartridge type, a pack type, or a tank type, may be adopted. Inks having various known compositions may be used. An ink to be used may include, for example, an aqueous dye-based ink or an aqueous pigment-based ink, an organic solvent-based ink (eco-solvent-based ink) having improved weathering resistance compared with the aqueous dye-based and pigment-based inks, or a photo-curable ink that hardens in response to irradiation with ultraviolet light.

The ink supply tube 17 is, for example, a flexible hollow tube made of a synthetic resin, and ink flow paths that correspond to respective ink cartridges 13 are formed within the ink supply tube 17. The recording head 10 is electrically connected to the main body of the printer 1 by a FFC (flexible flat cable) 18 that transmits activation signals from a control section (not shown) in the main body of the printer 1 to the recording head 10.

A capping mechanism 11 is disposed within the frame 2 at a home position in a side region (near the cartridge holder 14) within the moving range of the recording head 10. The capping mechanism 11 has a cap 12 that seals the nozzle face of the recording head 10. The capping mechanism 11 causes the cap 12 to seal the nozzle face of the recording head 10 (which is a bottom face of the recording head 10 that has the nozzles 30 and includes a nozzle plate 24 and a base plate 23) so as to restrain ink solvent from evaporating from the nozzles 30 while the recording head 10 is in a standby state at the home position. While the nozzle face of the recording head 10 is sealed, a negative pressure is applied to the sealed space in the capping mechanism 11 by using a suction device, such as a suction pump. In this state, a cleaning action (maintenance action) in which ink and bubbles are forcibly drawn from the nozzles 30 can be performed.

Figure 2:
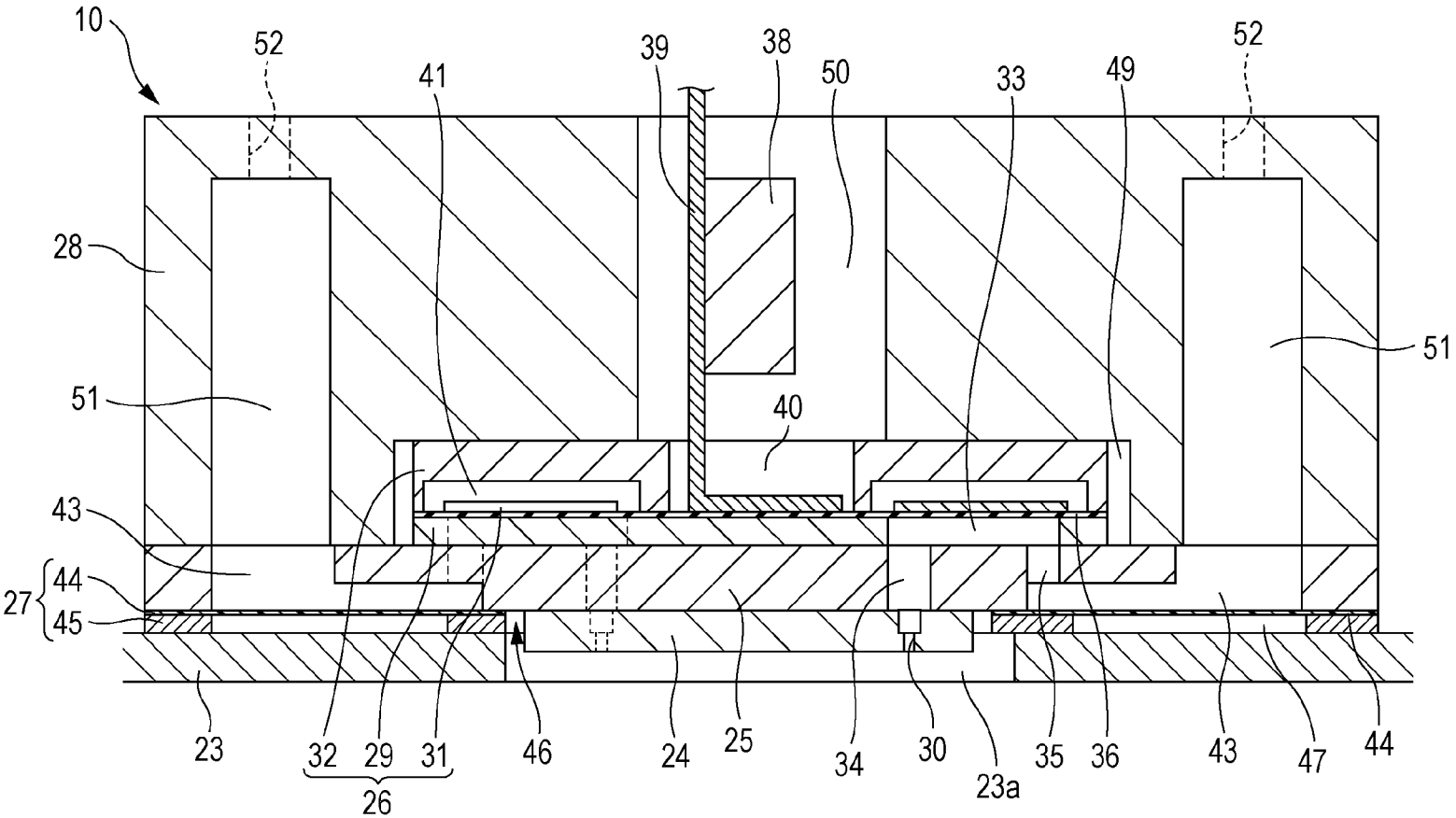
FIG. 2 is a cross-sectional view illustrating an example of a liquid ejecting head (ejection mechanism).

Next, a construction of the recording head 10 according to the embodiment will be described. FIG. 2 is a cross-sectional view illustrating the recording head 10. The recording head 10 according to the embodiment includes a plurality of components such as a base plate 23, a nozzle plate 24, a communication plate 25, an actuator substrate 26, a compliance substrate 27, and a housing 28. These components are stacked and joined to each other by using an adhesive or the like and are thereby formed into a single unit.

The actuator substrate 26 according to the embodiment includes a pressure chamber-forming substrate 29, piezoelectric devices 31, and a protection substrate 32, which are stacked in the actuator substrate 26. Pressure chambers 33 are formed in the pressure chamber-forming substrate 29 and are in communication with the nozzles 30 formed in the nozzle plate 24. The piezoelectric devices 31 are driving devices that cause pressure fluctuations in the ink in respective pressure chambers 33. The protection substrate 32 protects the pressure chamber-forming substrate 29 and the piezoelectric devices 31. A wiring space 40 is provided at a substantially central portion of the protection substrate 32 when viewed in plan view. A flexible circuit 39 equipped with an activation IC 38 is inserted into the wiring space 40. Lead electrodes extending from the piezoelectric devices 31 are disposed in the wiring space 40, and the lead electrodes are electrically connected to wiring terminals of the flexible circuit 39. The flexible circuit 39, which is electrically connected to the lead electrodes of each piezoelectric device 31, supplies activation signals or the like sent from the control section to the piezoelectric device 31 via the FFC 18. Note that the flexible circuit 39 is not limited to being equipped with the activation IC 38. The flexible circuit 39 may be formed so as not to be equipped with the activation IC 38. The activation IC 38 may be disposed separately on the protection substrate 32 and may function as an interposer.

The pressure chamber-forming substrate 29 of the actuator substrate 26 is made of a single crystal silicon substrate. In the pressure chamber-forming substrate 29, a plurality of spaces that form pressure chambers 33 are arranged in rows so as to correspond to the nozzles 30. Each pressure chamber 33 is a space extending longitudinally in a direction intersecting (orthogonally intersecting, according to the embodiment) the nozzle row direction. A longitudinal end of each pressure chamber 33 is in communication with a nozzle communication hole 34, while the other end is in communication with an individual communication hole 35. Two rows of the pressure chambers 33 are formed in the pressure chamber-forming substrate 29 according to the embodiment.

A vibrating plate 36 is stacked on the top surface (a surface facing away from the communication plate 25) of the pressure chamber-forming substrate 29. The vibrating plate 36 seals the upper opening of each pressure chamber 33. In other words, part of the pressure chamber 33 is defined by the vibrating plate 36. The vibrating plate 36 is formed, for example, of an elastic membrane and an insulation membrane. The elastic membrane is made of silicon dioxide ($SiO_2$) and formed on the top surface of the pressure chamber-forming substrate 29. The insulation membrane is made of zirconium oxide ($ZrO_2$) and formed on the elastic membrane. A piezoelectric device 31 is stacked on the vibrating plate 36 of each respective pressure chamber 33.

The piezoelectric device 31 according to the embodiment operates in a so-called bending mode. The piezoelectric device 31 is formed, for example, by consecutively stacking a lower electrode layer, a piezoelectric layer, and an upper electrode layer on top of the vibrating plate 36 (these layers are not shown). The piezoelectric device 31 formed as such is subjected to bending deformation in the up-and-down direction when an electric field is applied between the upper electrode layer and the lower electrode layer in accordance with the potential difference between the electrodes. In the embodiment, piezoelectric devices 31 are formed in two rows so as to correspond to respective pressure chambers 33 that are also formed in two rows. Note that the lower electrode layers and the upper electrode layers extend, as lead electrodes, from both rows of the piezoelectric devices 31 to the wiring space 40, which is located between the rows of the piezoelectric devices 31. The lead electrodes are electrically connected to the flexible circuit 39 as described above.

The protection substrate 32 is stacked on top of the vibrating plate 36 so as to cover the two rows of the piezoelectric devices 31. An elongated accommodation space 41 that can accommodate each row of the piezoelectric devices 31 is formed within the protection substrate 32. The accommodation space 41 is a recess that is formed halfway in the height direction of the protection substrate 32 from the lower side (near the vibrating plate 36) of the protection substrate 32 toward the upper side thereof (near the housing 28). The accommodation space 41 is formed on each side of the wiring space 40 in the protection substrate 32 according to the embodiment.

A communication plate 25, which has a surface area larger than that of the actuator substrate 26, is joined to the lower face of the actuator substrate 26. This communication plate 25 is made of a single crystal silicon substrate, as is the pressure chamber-forming substrate 29. The communication plate 25 according to the embodiment includes therein nozzle communication holes 34 that communicate with respective pressure chambers 33 and nozzles 30, reservoirs 43 that are provided so as to commonly serve the pressure chambers 33, and individual communication holes 35 that connect the respective pressure chambers 33 to the reservoirs 43. A reservoir 43 (otherwise called "common liquid chamber" or "manifold") is a space extending in the nozzle row direction. Two reservoirs 43 are provided in the communication plate 25 so as to correspond to the two nozzle rows of the nozzle plate 24. A reservoir 43 is provided for each type of ink. A plurality of individual communication holes 35, which correspond to respective pressure chambers 33, are formed along the nozzle row. Each individual communication hole 35 enables communication with the other longitudinal end (the end opposite to the nozzle communication hole 34) of the pressure chamber 33.

The nozzle plate 24 in which a plurality of nozzles 30 are formed is joined to the lower surface of the communication plate 25 at a substantially central portion thereof. The nozzle plate 24 according to the embodiment is a plate made of a single crystal silicon substrate having an external shape smaller than that of the communication plate 25 or the actuator substrate 26. The nozzle plate 24 is joined to the bottom surface of the communication plate 25 by using an adhesive or the like. On the bottom surface, a region to which the nozzle plate 24 is joined is distant from the openings of the reservoirs 43 and at the openings of the nozzle communication holes 34. Thus, the nozzle communication holes 34 are in communication with respective nozzles 30. The nozzle plate 24 according to the embodiment has two nozzle rows formed therein, and each nozzle row includes a plurality of nozzles 30.

The compliance substrate 27 is joined to the bottom surface of the communication plate 25. The compliance substrate 27 has, at the center thereof, a through-opening 46 that is shaped so as to follow and surround the outer periphery of the nozzle plate 24. The through-opening 46 of the compliance substrate 27 is formed so as to communicate with a through-hole 23*a* of the base plate 23 and to enable the nozzle plate 24 to be disposed therein. The compliance substrate 27 is appropriately positioned and joined to the bottom surface of the communication plate 25 so that the compliance substrate 27 seals the opening of the reservoir 43 in the bottom surface of the communication plate 25. The compliance substrate 27 according to the embodiment is formed of a compliant sheet 44 and a supporting plate 45 that is joined to and supports the compliant sheet 44.

The compliant sheet 44 of the compliance substrate 27 is joined to the bottom surface of the communication plate 25 such that the compliant sheet 44 is sandwiched between the communication plate 25 and the supporting plate 45. The compliant sheet 44 is a flexible membrane made of a synthetic resin, such as polyphenylene sulfide (PPS). The supporting plate 45 is made of a metal, such as stainless steel, having a high rigidity and a large thickness compared with the compliant sheet 44. A portion of the supporting plate 45 that faces the reservoir 43 is removed such that the shape of the removed portion follows the bottom opening of the reservoir 43. Accordingly, the bottom opening of the reservoir 43 is sealed by the compliant sheet 44, which has flexibility. In other words, part of the reservoir 43 is defined by the compliant sheet 44.

The base plate 23 is joined to the bottom surface of the supporting plate 45. Thus, a compliance space 47 is formed between the deformation area of the compliant sheet 44 and the base plate 23 that faces this deformation area. The deformation area of the compliant sheet 44 in the compliance space 47 is deformed toward the compliance space 47 or toward the reservoir 43 in response to pressure fluctuation within the ink flow path, especially within the reservoir 43. Thus, the thickness of the supporting plate 45 is determined so as to provide a sufficient height for the compliance space 47.

The actuator substrate 26 and the communication plate 25 are fixed to the housing 28. A housing space 49 that houses the actuator substrate 26 is formed at the bottom of the housing 28. While the actuator substrate 26 is housed in the housing space 49, the bottom face of the housing 28 is sealed by the communication plate 25. As illustrated in FIG. 2, an insertion space 50 that communicates with the housing space 49 opens at a substantially central portion of the housing 28 when viewed in plan view. The insertion space 50 is also in communication with the wiring space 40 of the actuator substrate 26. The flexible circuit 39 is formed such that it can be inserted into the wiring space 40 through the insertion space 50. Liquid chamber spaces 51 are formed in the housing 28 on both sides of the insertion space 50 and the housing space 49. The liquid chamber spaces 51 are in communication with the reservoirs 43 of the communication plate 25. In addition, inlets 52 that communicate with respective liquid chamber spaces 51 open in the top face of the housing 28. Each inlet 52 is in communication with an outflow path 65 of the valve unit 21, which will be described later. Thus, the ink delivered from the valve unit 21 is introduced to the inlet 52 and the liquid chamber space 51 and subsequently to the reservoir 43. The ink is supplied from the reservoir 43 to each pressure chamber 33 through each individual communication hole 35.

The base plate 23 is, for example, a plate made of a metal, such as stainless steel. In the base plate 23 according to the embodiment, a through-hole 23*a* is formed through the base plate 23 in the thickness direction at a position corresponding to the nozzle plate 24. The through-hole 23*a* is shaped so as to follow the outer periphery of the nozzle plate 24 and to expose the nozzles 30 of the nozzle plate 24 therethrough. As described above, the through-hole 23*a* is in communication with the through-opening 46 of the compliance substrate 27. In the embodiment, the nozzle face according to the invention is constituted by the bottom face of the base plate 23 and the portion of the nozzle plate 24 that is exposed through the through-hole 23*a*. The base plate 23 is joined, by using an adhesive or the like, to a retaining member (not shown) that accommodates the housing 28 to which the actuator substrate 26 and the communication plate 25 are fixed.

In the recording head 10 formed as such, the flow path from the liquid chamber space 51 to a nozzle 30 via the reservoir 43 and a pressure chamber 33 is filled with ink. In this state, actuation of the piezoelectric device 31 in accordance with the activation signal from the activation IC 38 generates pressure fluctuation within the pressure chamber 33. The pressure fluctuation causes the corresponding nozzles 30 to eject ink.

Figure 3:
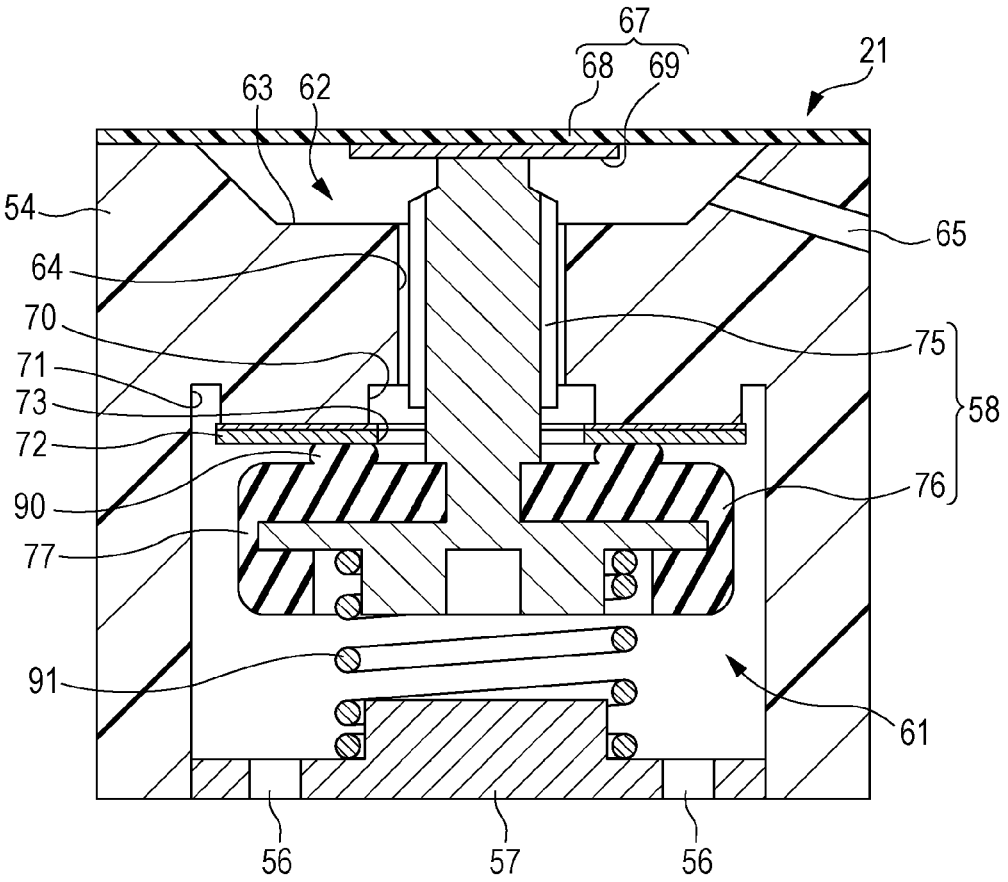
FIG. 3 is a cross-sectional view illustrating an example of a valve unit when the valve is closed.
Figure 4:
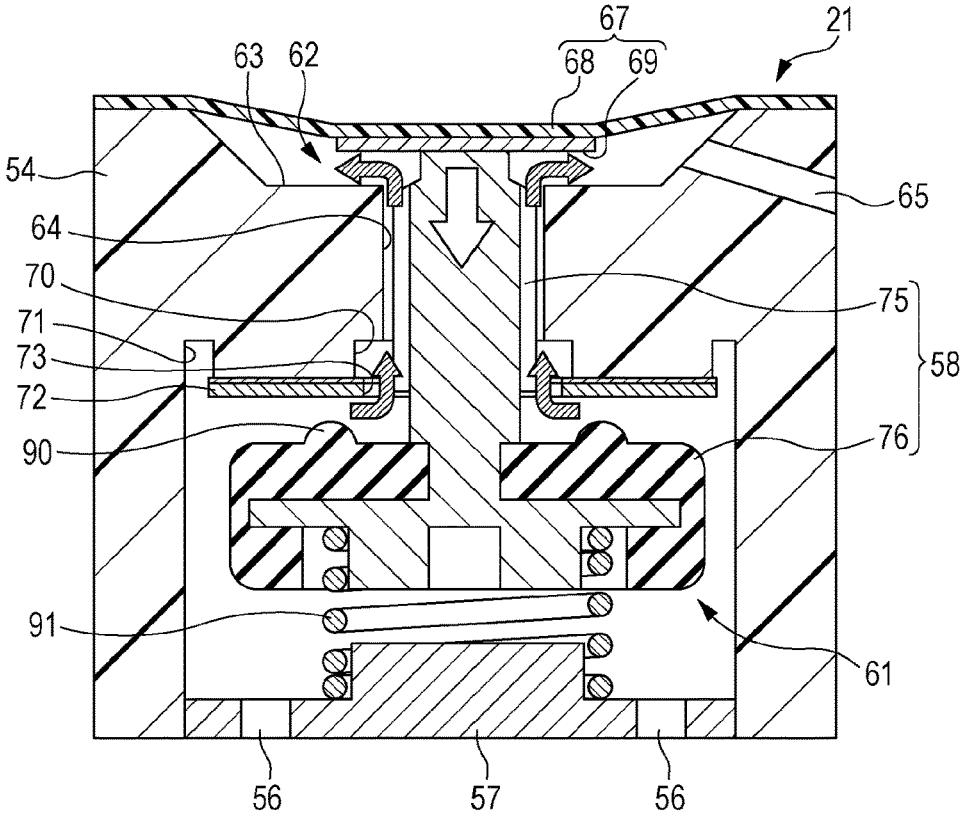
FIG. 4 is a cross-sectional view illustrating the example of the valve unit when the valve is open.

FIG. 3 and FIG. 4 are cross-sectional views schematically illustrating an example of the valve unit 21. The valve unit 21 is closed in FIG. 3 and is open in FIG. 4. The valve unit 21 according to the embodiment is a member that adjusts the supply pressure of ink that is supplied from an ink cartridge 13 to the recording head 10. The valve unit 21 according to the embodiment includes a pressure regulation valve 58 (corresponding to a valve body according to the invention) within a valve-unit body 54 that is made of synthetic resin or the like. The valve-unit body 54 according to the embodiment is made of a synthetic resin, such as, for example, polypropylene (PP) or modified polyphenylene ether (i.e., modified PPE, also referred to as "Xyron®") or the like.

The valve-unit body 54 includes a valve chamber 61 in which the pressure regulation valve 58 is disposed, a pressure regulation chamber 62 that is in communication with the valve chamber 61, and a pressure-receiving member 67 that seals an opening of the pressure regulation chamber 62. The pressure regulation chamber 62 is a recess that is depressed from one face (upper face in FIG. 3) of the valve-unit body 54 toward the opposite face (lower face in FIG. 3). The pressure regulation chamber 62 is separated from the valve chamber 61 by a partition wall 63 (corresponding to a hole member according to the invention). The pressure regulation chamber 62 and the valve chamber 61 communicate with each other via a communication hole 64 (corresponding to a hole according to the invention) that is formed through the partition wall 63. An outflow path 65 that communicates with outside the valve unit 21 is formed in the pressure regulation chamber 62 at a position downstream of the communication hole 64. The outflow path 65 is a flow path through which ink flows from the pressure regulation chamber 62 to the recording head 10.

An opening of the pressure regulation chamber 62 that opens in one face of the valve-unit body 54 is sealed by the pressure-receiving member 67 that is shaped like a diaphragm. The pressure-receiving member 67 is constituted by a film member 68 and a pressure-receiving plate 69 that is disposed on the inside surface of the film member 68. The film member 68 is a flexible film that is elastically deformed toward inside the pressure regulation chamber 62 (i.e., toward the other face of the valve-unit body 54) when the pressure in the pressure regulation chamber 62 decreases. The film member 68 is, for example, a thin film having flexibility. The film member 68 can be formed, for example, of a polyethylene or polypropylene film to which a nylon film coated with vinylidene chloride is laminated by adhesion. Alternatively, the film member 68 may be made of polyethylene terephthalate (PET). The film member 68 is fixed to one face of the valve-unit body 54 by adhesion or welding so as to seal the opening of the recess that becomes the pressure regulation chamber 62 (i.e., to seal the opening in one face of the pressure regulation chamber 62). Thus, part of the pressure regulation chamber 62 is defined by the film member 68. The pressure-receiving plate 69 is, for example, a disk-like member made of synthetic resin, metal, or the like, and is fixed, by adhesion or welding, to the surface of the film member 68 that faces the pressure regulation chamber 62. The pressure-receiving plate 69 is in contact with a tip portion 80 of a shaft section 75 of the pressure regulation valve 58 (see FIG. 5).

The valve chamber 61 is a cylindrical space that is formed in the valve-unit body 54 in a region opposite to the pressure regulation chamber 62 with the partition wall 63 being formed between the valve chamber 61 and the pressure regulation chamber 62. The valve chamber 61 mainly accommodates a sealing section 76 of the pressure regulation valve 58 and an urging member 91 that urges the pressure regulation valve 58 toward the partition wall 63 (so as to open the valve). The communication hole 64 opens in the partition wall 63 that faces the valve chamber 61. The flow path of the communication hole 64 according to the embodiment has a circular cross-section (circular opening). A spacer 72 (corresponding to a contact member according to the invention) is disposed around the opening of the communication hole 64. In the surface of the partition wall 63 that faces the valve chamber 61, a portion of the surface in which the spacer 72 is provided functions as a valve seat according to the invention (this portion may be, from time to time, referred to as the valve seat). Details about the spacer 72 will be described later. The opening of the valve chamber 61, which is located opposite to the valve seat (i.e., opposite to the pressure regulation chamber 62), is closed by a lid member 57 through which inflow ports 56 are formed. Ink delivered from an ink cartridge 13 via the ink supply tube 17 is introduced into the valve unit 21, and the ink subsequently passes through an internal flow path (not shown) and flows through the inflow ports 56 into the valve chamber 61. In the embodiment, a series of flow paths from the inflow ports 56 to the valve chamber 61, the communication hole 64, the pressure regulation chamber 62, and subsequently to the outflow path 65 serve as a flow path according to the invention. Thus, the communication hole 64 constitutes part of the flow path.

In the communication hole 64, the opening that faces the valve chamber 61 has a diameter larger than that of the opening that faces the pressure regulation chamber 62. More specifically, the communication hole 64 according to the embodiment includes an enlarged portion 70 in a region near the valve chamber 61 (near the spacer 72). The inner diameter of the enlarged portion 70 is larger than any other inner diameter of the communication hole 64. This enlarged portion 70 is formed to provide a space that accepts residual adhesive when the spacer 72 is adhered by using an adhesive to an area surrounding the opening of the communication hole 64 that faces the valve chamber 61. In addition, a relieving recess 71 is formed around the area to which the spacer 72 is adhered in the valve chamber 61. The relieving recess 71 is a recess that is depressed from the surface of the partition wall 63 toward the pressure regulation chamber 62. The relieving recess 71 also serves as a space for accepting residual adhesive when the spacer 72 is adhered. Residual adhesive may escape from between the partition wall 63 and the spacer 72. This arrangement restrains the residual adhesive from hampering ink flow in the flow path or from hampering opening/closing of the pressure regulation valve 58. Incidentally, the opening of the enlarged portion 70 that faces the valve chamber 61 may be described, from time to time, as the opening of the communication hole 64 that faces the valve chamber 61. Note that in the communication hole 64, the enlarged portion 70 need not form a step with the other portion (portion having a diameter smaller than that of the enlarged portion 70). For example, instead of providing the step, the enlarged portion 70 may be continuously tapered toward the other portion (i.e., the inner diameter may continuously decreases from the enlarged portion 70 to the other portion). Also note that the communication hole 64 need not necessarily include the enlarged portion 70. In other words, the communication hole 64 may be formed such that the inner diameter of the flow path is substantially constant (the inner diameter does not change so much as to form a step).

The spacer 72 is a member that is more rigid than the valve-unit body 54 of synthetic resin. For example, the spacer 72 is made of a metal such as stainless steel, a glass ceramics, or a single crystal silicon substrate and is shaped like a disk. In short, a material that is more rigid and more resistant to ink than the valve-unit body 54 can be adopted for the spacer 72. An opening 73, which is in communication with the communication hole 64, is formed at a central portion of the spacer 72. The inner diameter of the opening 73 is made similar to that of the communication hole 64 that faces valve chamber 61, in other words, similar to the inner diameter of the enlarged portion 70 according to the embodiment. The surface (contact surface) of the spacer 72 with which the sealing section 76 of the pressure regulation valve 58 comes into contact is treated to have a liquid repellency higher than that of any other portion in the flow path in the valve unit 21. In other words, a liquid-repellent coating is formed on the contact surface of the spacer 72. For example, the liquid-repellent coating is made of a material exhibiting repellency against ink, such as a metal film containing a fluorine-based polymer, or a metal-alkoxide molecular film having liquid repellency.

The liquid-repellency treatment on the contact surface of the spacer 72 suppresses accumulation of ink (solute) on the contact surface with which the pressure regulation valve 58 is brought into contact repeatedly. In the embodiment, by adopting a metal spacer 72, the accumulation of ink is suppressed more reliably compared, for example, with the case in which the liquid-repellency treatment is applied directly on the valve-unit body 54 (on the partition wall 63) made of a synthetic resin. As a result, the sealing ability of the pressure regulation valve 58 when the valve is closed can be improved. In particular, for example, in the case in which an ink containing resin solute such as thermoplastic resin particles is used, such a resin component tends to accumulate on a synthetic resin surface that has a composition closer to that of the resin component. In other words, even if the liquid-repellency treatment is applied directly on the valve-unit body 54 (partition wall 63) that is made of synthetic resin, it may be difficult to reliably prevent accumulation of a resin component. However, as in the embodiment, adopting a metal spacer 72, of which the composition is different from that of a resin component that the ink contains, can suppress the accumulation of such a resin component more efficiently. Note that in the embodiment, the spacer 72 is joined to the valve-unit body 54 by using an adhesive. However, the joining method is not limited to using an adhesive. For example, various methods, such as welding by heating or by vibration or using fixation members such as screws, can be adopted for this purpose.

Figure 5:
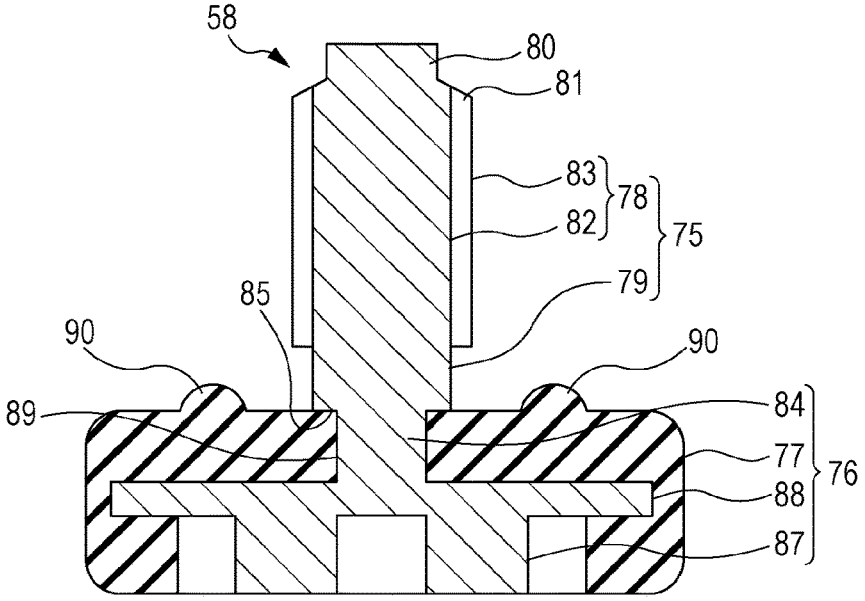
FIG. 5 is a cross-sectional view illustrating a pressure regulation valve.
Figure 6:
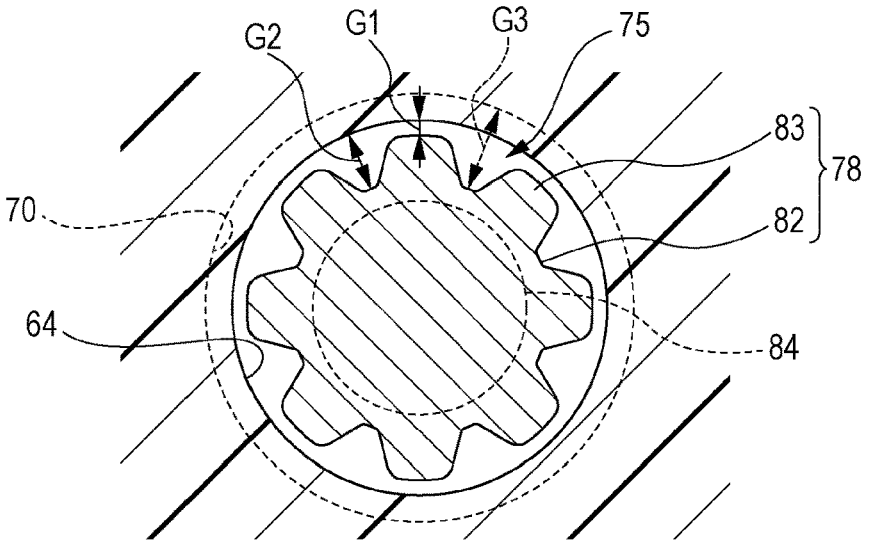
FIG. 6 is a cross-sectional view of a shaft section of the pressure regulation valve taken in a radial direction thereof.

FIG. 5 is a cross-sectional view illustrating a construction of the pressure regulation valve 58 taken in the axial direction thereof (in the open/close direction). FIG. 6 is a cross-sectional view illustrating the shaft section 75 of the pressure regulation valve 58 taken in a radial direction thereof (in a direction orthogonally intersecting the axial direction). The pressure regulation valve 58 according to the embodiment moves (forward and backward) in the axial direction of the shaft section 75 (corresponding to a first direction according to the invention) relative to the valve seat (i.e., the partition wall 63 and the spacer 72) and thereby opens/closes the communication hole 64. The pressure regulation valve 58 is thus switched between a valve-open state in which ink can flow in the communication hole 64 and a valve-closed state in which ink cannot flow in the communication hole 64. The pressure regulation valve 58 is disposed in the valve chamber 61 in such a manner that the pressure regulation valve 58 is urged toward the valve-closed position, in other words, urged toward the valve seat, by the urging member 91 such as, for example, a coil spring. The pressure regulation valve 58 is constituted by the shaft section 75 and the sealing section 76 (corresponding to a first portion according to the invention).

The shaft section 75 according to the embodiment includes a guide portion 78 (corresponding to a second portion according to the invention), which has a large thickness, and a small-diameter portion 79 (corresponding to a third portion according to the invention), which has a small thickness. The small-diameter portion 79 is a columnar portion located between the guide portion 78 and the sealing section 76 in the axial direction. A tip portion 80, which has a thickness smaller than the small-diameter portion 79, is provided at the end of the guide portion 78 that is opposite to the small-diameter portion 79. The end surface of the tip portion 80 that is located opposite to the sealing section 76 functions as a contact surface that abuts the pressure-receiving member 67. A tapered portion 81 is formed between the tip portion 80 and the guide portion 78. The tapered portion 81 is a portion that is chamfered such that the thickness gradually decreases from the guide portion 78 toward the tip portion 80 (corresponding to a tapered shape according to the invention). Providing the shaft section 75 with the tapered portion 81 facilitates insertion of the shaft section 75 into the communication hole 64 when mounting the pressure regulation valve 58 on the valve unit 21, thereby improving work efficiency during assembly. This also reduces the likelihood of the shaft section 75 abrading, or clinging to, the valve seat when opening/closing the pressure regulation valve 58, enabling the pressure regulation valve 58 to move smoothly relative to the valve seat. Thus, this contributes to stable operation of the pressure regulation valve 58.

The shaft section 75 is inserted into the communication hole 64 from the valve chamber 61. The tip portion 80 is located within the pressure regulation chamber 62 in the valve-closed state. As illustrated in FIG. 6, the shaft section 75 is located inside the communication hole 64 when viewed in plan view in the axial direction. The guide portion 78 according to the embodiment includes a main shaft 82 that is shaped like a column and projections 83 that are shaped like ribs and arranged at a constant spacing along the periphery of the main shaft 82. The main shaft 82 according to the embodiment is a columnar portion that continues to the small-diameter portion 79, and the diameter of the main shaft 82 is made similar to the diameter of the small-diameter portion 79. Each projection 83 is a portion projecting from the outer surface of the main shaft 82 in the radial direction thereof (corresponding to a second direction according to the invention) and having a trapezoidal shape when viewed in cross section. Each projection 83 is formed continuously from the border between the main shaft 82 and the tapered portion 81 to the border between the main shaft 82 and the small-diameter portion 79. In the embodiment, a total of eight projections 83 are disposed along the outer surface of the main shaft 82. Note that the cross-sectional shape of each projection 83 is not limited to the trapezoid shape, but a variety of shapes including a semicircular shape and a triangular shape can be adopted.

In the embodiment, when viewed in the axial direction, the communication hole 64 is shaped like a circle, while the guide portion 78 is shaped like a gear in which convex and concave portions are formed alternately along the outer surface of the main shaft 82. Accordingly, the gap between the communication hole 64 and the shaft section 75 includes a first gap width G1, which is relatively small, and a second gap width G2, which is relatively large. More specifically, the first gap width G1 is a width between the inner circumferential surface of the communication hole 64 and the projected end of each projection 83 that faces the circumferential surface, whereas the second gap width G2 is a width between the inner circumferential surface of the communication hole 64 and the outer circumferential surface of the main shaft 82. In the embodiment, the diameter of the main shaft 82 of the guide portion 78 is made similar to the diameter of the small-diameter portion 79. Thus, the distance between the small-diameter portion 79 and the communication hole 64 is equal to the second gap width G2. In addition, the distance between the small-diameter portion 79 and the enlarged portion 70 of the communication hole 64 is a third gap width G3, which is larger than the second gap width G2. The size relationship of G1, G2, and G3 is G1<G2<G3. These gaps having widths of G1 to G3 function as the flow path of ink that flows from the valve chamber 61 to the pressure regulation chamber 62 when the pressure regulation valve 58 is open. These gap widths G1 to G3 are widths when the shaft section 75 and the communication hole 64 are arranged coaxially. With this construction, when viewed in the axial direction, the gap between the communication hole 64 and the small-diameter portion 79 is larger than the gap between the communication hole 64 and the guide portion 78. Note that if a plurality of gap widths are present in the gap between the communication hole 64 and the small-diameter portion 79 or between the communication hole 64 and the guide portion 78, the smallest widths are to be taken for this comparison.

The shaft section 75 is inserted into, and disposed within, the communication hole 64. In this state, portions having the first gap width G1, in other words, portions including the projected ends of the projections 83 of the guide portion 78 and the inner circumferential surface of the communication hole 64, regulate the position of the pressure regulation valve 58, with a high accuracy, with respect to the valve seat in the direction intersecting the axial direction of the communication hole 64. Moreover, when the pressure regulation valve 58 opens/closes, the portions corresponding to the first gap width G1 guide the pressure regulation valve 58 relative to the valve seat. This reduces the likelihood of the pressure regulation valve 58 inclining or being displaced relative to the valve seat in a direction intersecting the axial direction of the pressure regulation valve 58. When opening the valve, portions having the second gap width G2 facilitate a smooth ink flow in the communication hole 64. In addition, the small-diameter portion 79, which is provided between the guide portion 78 and the sealing section 76, helps to form a large space between the pressure regulation valve 58 and the valve seat. This space functions as a relieving space, which reduces the likelihood of the pressure regulation valve 58 interfering with the valve seat, especially with the portion surrounding the communication hole 64 while opening/closing the valve. Thus, this reduces the likelihood of the pressure regulation valve 58 inclining or being displaced relative to the valve seat due to the interference between the pressure regulation valve 58 and the valve seat, thereby enabling the pressure regulation valve 58 and the valve seat to open/close the communication hole 64 smoothly. Thus, deterioration in durability of the pressure regulation valve 58 or the valve seat is suppressed. As a result, the valve unit 21 can be operated for a long period of time. In the embodiment, a rigid spacer 72 is provided as the valve seat. In this construction, even in the case in which the opening 73 of the spacer 72 becomes out of exact alignment with the communication hole 64 due to positioning deviation and thereby a portion of the spacer 72 crosses over the inner circumferential surface (toward the center of the communication hole 64) and protrudes into the communication hole 64, the likelihood of the protruded portion of the spacer 72 interfering with the shaft section 75 is reduced, which leads to smooth opening/closing of the pressure regulation valve 58. This results in stable operation of the valve unit 21. Moreover, in the embodiment, the communication hole 64 has the enlarged portion 70 in the valve chamber 61, which reliably reduces the likelihood of the pressure regulation valve 58 interfering with the valve seat when the pressure regulation valve 58 opens/closes.

Note that it is sufficient that the guide portion 78 stays inside the communication hole 64 in the axial direction at least during opening/closing of the pressure regulation valve 58. The guide portion 78 may have a portion that stays outside the communication hole 64 when the valve is open or closed. Similarly, it is sufficient that the small-diameter portion 79 stays inside the communication hole 64 in the axial direction at least during opening/closing of the pressure regulation valve 58 (especially during closing of the valve). The small-diameter portion 79 may have a portion that stays outside the communication hole 64 when the valve is open.

The sealing section 76 is a portion that opens/closes the communication hole 64 by moving, in the valve chamber 61, to and from the surface of the partition wall 63, which serves as the valve seat. The sealing section 76 according to the embodiment includes a base portion 87 that is shaped like a column and a disk-shaped flange portion 88 that has a diameter larger than the base portion 87. The surface of the flange portion 88 that is opposite to the base portion 87 functions as a sealing face (corresponding to a retaining portion according to the invention) against the valve seat. The surface area of the sealing face is made larger than the opening area (i.e., the opening area of the enlarged portion 70) of the communication hole 64 in the valve chamber 61. The shaft section 75 protrudes from the center of the flange portion 88 so as to intersect the sealing face orthogonally. In addition, the sealing section 76 includes a connecting-shaft portion 84 (corresponding to a narrow portion according to the invention) that is provided between the small-diameter portion 79 of the shaft section 75 and the sealing section 76 in the axial direction. The connecting-shaft portion 84 connects the small-diameter portion 79 to the flange portion 88. The base portion 87, the flange portion 88, the connecting-shaft portion 84, and the shaft section 75 are, for example, integrally formed of a synthetic resin, such as polypropylene, as is the valve-unit body 54.

Figure 7:
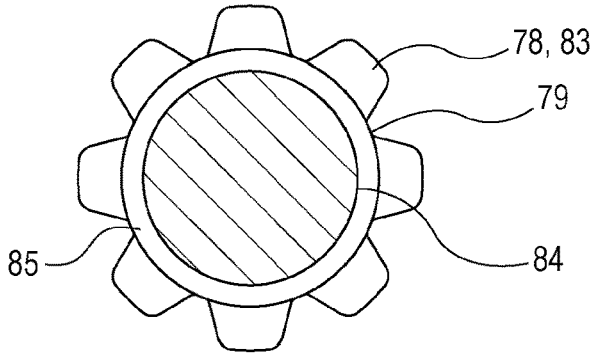
FIG. 7 is a cross-sectional view of a connecting-shaft portion taken in a radial direction thereof.

FIG. 7 is a cross-sectional view of the connecting-shaft portion 84 taken in a radial direction when the connecting-shaft portion 84 is viewed from the sealing section 76 toward the shaft section 75 in the axial direction. The connecting-shaft portion 84 according to the embodiment has a diameter smaller than that of the small-diameter portion 79. Thus, a step portion 85 is formed around the entire periphery of the connecting-shaft portion 84 at the position between the small-diameter portion 79 and the connecting-shaft portion 84. In other words, the connecting-shaft portion 84 is generally smaller in thickness than the small-diameter portion 79. The diameter of a through-hole 89 of an elastic member 77 (which will be described later) is made similar to the diameter of the connecting-shaft portion 84. In addition, the length of the connecting-shaft portion 84 in the axial direction (i.e., the length between the border with the sealing face and the border with the small-diameter portion 79) is made similar to the thickness of the elastic member 77. When mounting the elastic member 77 on the flange portion 88, the tip portion 80 of the shaft section 75 is inserted through the through-hole 89 of the elastic member 77. When the through-hole 89 of the elastic member 77 passes through the guide portion 78 and the small-diameter portion 79 that are larger in diameter than the connecting-shaft portion 84, the through-hole 89 is elastically expanded. The expanded through-hole 89 returns to the original shape due to its elasticity after the through-hole 89 passes the small-diameter portion 79 and reaches the connecting-shaft portion 84. In the state in which the elastic member 77 is installed on the sealing face of the flange portion 88, the connecting-shaft portion 84 is surrounded by the elastic member 77. The portion of the elastic member 77 surrounding the through-hole 89 engages the step portion 85. This prevents the elastic member 77 from being displaced such that the elastic member 77 rises, or is disengaged, from the sealing face of the flange portion 88. In addition, the connecting-shaft portion 84 has a thickness smaller than that of the shaft section 75 so that the through-hole 89 of the elastic member 77 can be made smaller, resulting in an increase in the contact area between the elastic member 77 and the sealing face of the flange portion 88. Thus, displacement of the elastic member 77 with respect to the sealing face of the flange portion 88 is suppressed more reliably.

The elastic member 77 is installed on the flange portion 88 so as to cover the sealing face. The elastic member 77 is made, for example, of an elastomer or the like. The through-hole 89 opens at the center portion of the elastic member 77 that covers the sealing face. The elastic member 77 according to the embodiment extends over the outer edge of the sealing face and is bent toward the face of the flange portion 88 that is opposite to the sealing face (i.e., face of the side having the base portion 87). The elastic member 77 is further bent toward the center of the flange portion 88 such that the elastic member 77 is overlaid on the outer edge of the face of the flange portion 88 that is opposite to the sealing face. In other words, the elastic member 77 according to the embodiment is fitted into the flange portion 88 so as to cover the sealing face of the flange portion 88, the side face of the flange portion 88, and a portion of the face of the flange portion 88 that is opposite to the sealing face. The elastic member 77 is fitted in such a manner, and moreover, the portion of the elastic member 77 surrounding the through-hole 89 engages the step portion 85. This suppresses displacement of the elastic member 77 efficiently with respect to the flange portion 88. Note that the method of mounting the elastic member 77 on the flange portion 88 is not limited to the fitting described above by way of example. Adhesion using an adhesive or co-injection molding may be used to integrate the elastic member 77 and the flange portion 88 into one piece. It is sufficient that the elastic member 77 is provided on the sealing face of the flange portion 88 at least in an area that abuts the spacer 72 (or an area surrounding the communication hole 64 if the construction does not include the spacer 72).

In the embodiment, an abutting portion 90 is integrally formed on the elastic member 77 at a position opposing the valve seat (the spacer 72). The abutting portion 90 is shaped like a semicircle when viewed in a cross section taken along the shaft. When the valve is closed, as illustrated in FIG. 3, the elastic member 77 comes into close contact with the spacer 72 of the valve seat (the partition wall 63) because of the elasticity of the abutting portion 90. Accordingly, the portion surrounding the communication hole 64 is sealed liquid-tightly. In other words, the communication hole 64 is closed.

An urging member 91, such as a coil spring, is disposed between the flange portion 88 of the sealing section 76 and the lid member 57. The urging member 91 abuts the face of the flange portion 88 of the sealing section 76 that is opposite to the sealing face and urges the entire pressure regulation valve 58 toward the valve seat. The urging member 91 maintains the valve-closed state until the pressure in the pressure regulation chamber 62 decreases to a predetermined value. In other words, the pressure regulation valve 58 is maintained at the valve-closed position at which the elastic member 77 of the sealing section 76 is in close contact with the spacer 72 that is disposed on the portion surrounding the communication hole 64 unless the pressure regulation valve 58 is subjected to a stress resisting the urging force of the urging member 91. When the pressure regulation valve 58 is in the valve-closed state at the valve-closed position, the pressure regulation valve 58 cuts off ink flow from the valve chamber 61 into the pressure regulation chamber 62.

When ink flowing into the pressure regulation chamber 62 is cut off by the pressure regulation valve 58, the internal pressure of the pressure regulation chamber 62 gradually decreases due to ink being consumed by the recording head 10. When the pressure inside the pressure regulation chamber 62 decreases, the pressure difference with respect to atmospheric pressure causes the film member 68 of the pressure-receiving member 67 to deform toward inside the pressure regulation chamber 62 and to push the pressure-receiving plate 69 toward the partition wall 63 (toward the pressure regulation valve 58). As a result, the pressure-receiving plate 69 pushes the tip portion 80 of the shaft section 75 of the pressure regulation valve 58 that is located at the valve-closed position. The pressure-receiving plate 69 causes the pressure regulation valve 58 to move away from the valve seat (i.e., away from the partition wall 63 and the spacer 72) in the axial direction against the elastic force of the urging member 91 (see the solid-white arrow in FIG. 4). Accordingly, as illustrated in FIG. 4, the abutting portion 90 of the elastic member 77 is separated from the spacer 72 of the valve seat, and the pressure regulation valve 58 is displaced to the position at which the pressure regulation valve 58 is released from the close-contact state (to the valve-open position).

In the valve-open state described above, ink is allowed to flow from the valve chamber 61 to the pressure regulation chamber 62 through the communication hole 64 (see the shaded arrows in FIG. 4). The ink that flows into the pressure regulation chamber 62 is subsequently supplied to the ink flow path of the recording head 10 via the outflow path 65. After the valve is open, ink flows into the pressure regulation chamber 62. This causes the internal pressure to increase gradually in the pressure regulation chamber 62. The increase in the internal pressure in the pressure regulation chamber 62 displaces the pressure-receiving member 67 gradually in a direction away from the partition wall 63 (away from the pressure regulation valve 58). Consequently, the pressure regulation valve 58 is displaced toward the valve seat due to the urging force of the urging member 91 and reaches the valve-closed position. Finally, the abutting portion 90 of the elastic member 77 comes into close contact with the spacer 72 of the valve seat, plugs up the communication hole 64, and cuts off ink flowing into the pressure regulation chamber 62.

In summary, the printer 1 according to the invention is equipped with the valve unit 21 that can operate stably for a long period of time, which can impart a long-term reliability to the printer 1.

Figure 8:
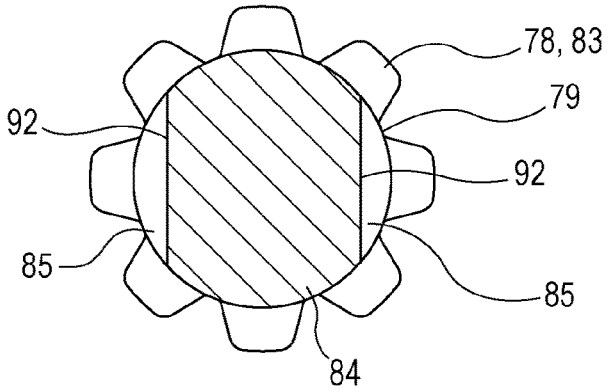
FIG. 8 is a cross-sectional view illustrating a connecting-shaft portion according to a modification example taken in a radial direction thereof.

Next, modification examples of the valve unit 21 and another embodiment will be described. FIG. 8 is a cross-sectional view illustrating a modification example of the connecting-shaft portion 84 when the connecting-shaft portion 84 is viewed, as is FIG. 7, from the sealing section 76 toward the shaft section 75 in the axial direction. Note that components having functions similar to those in the above-described embodiment will be denoted by like reference symbols, and no further description will be provided. The connecting-shaft portion 84 according to the above-described first embodiment is generally shaped like a column, which has a diameter smaller than that of small-diameter portion 79. However, the connecting-shaft portion 84 is not limited to this construction. It is sufficient that the connecting-shaft portion 84 at least has a portion that has a thickness smaller than that of the small-diameter portion 79 when viewed in the axial direction. The connecting-shaft portion 84 in the modification example illustrated in FIG. 8 is formed like a column generally having a diameter similar to the small-diameter portion 79 and has two cutout portions 92 that is formed by cutting out a portion of the column from the peripheral surface partially toward the center of the column. The thickness (i.e., the length in the radial direction) of the connecting-shaft portion 84 where the cutout portions 92 are formed is made smaller than that of the small-diameter portion 79. Thus, a step portion 85 is formed between the small-diameter portion 79 and the connecting-shaft portion 84. In the present modification example, the portion of the elastic member 77 surrounding the through-hole 89 also engages the step portion 85. This suppresses displacement of the elastic member 77 relative to the sealing face of the flange portion 88. In short, it is sufficient that the connecting-shaft portion 84 is positioned between the small-diameter portion 79 and the sealing face of the flange portion 88 in the first direction and that the connecting-shaft portion 84 has a portion of which the thickness is smaller than that of the small-diameter portion 79 in the radial direction that intersects the axial direction (in the embodiment, orthogonally intersects the axial direction).

Figure 9:
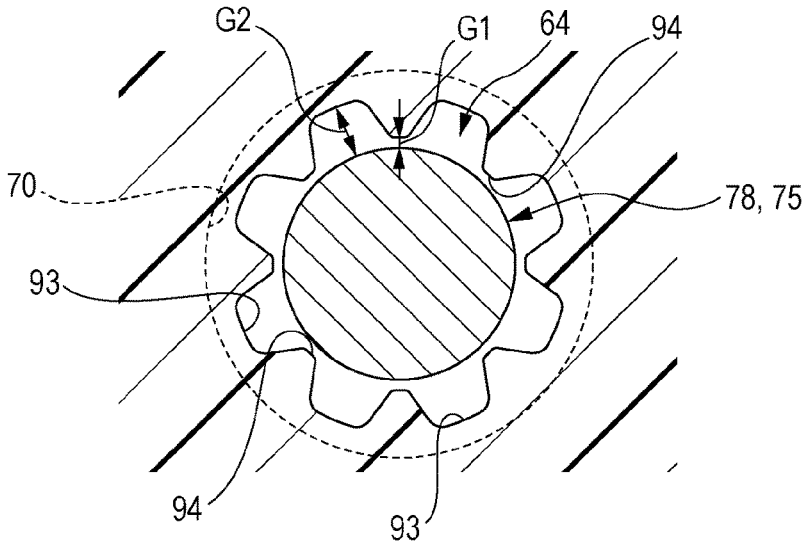
FIG. 9 is a cross-sectional view taken in a radial direction of a communication hole, which illustrates a modification example of the communication hole at a shaft section of the pressure regulation valve and at a valve seat.

FIG. 9 is a cross-sectional view is taken in a radial direction of the communication hole 64, which illustrates a modification example of the communication hole 64 at the shaft section 75 of the pressure regulation valve 58 and at the valve seat. In the foregoing embodiment, it has been described by way of example that when viewed in the axial direction, the communication hole 64 is shaped like a circle and the guide portion 78 of the shaft section 75 of the pressure regulation valve 58 has convex and concave portions. However, the communication hole 64 and the guide portion 78 are not limited to this construction. The guide portion 78 of the shaft section 75 exemplified in FIG. 9 is shaped like a circle when viewed in the axial direction. In other words, the guide portion 78 is formed into a column. On the other hand, the communication hole 64 according to the present modification example has a plurality of recesses 93 that are arranged at a constant spacing along the inner circumferential surface of the communication hole 64. Each recess 93 is a groove that is continuously formed in the axial direction in the communication hole 64 from the opening edge near the pressure regulation chamber 62 to a position near the small-diameter portion 79. A total of eight recesses 93 are disposed along the inner circumferential surface of the communication hole 64 according to the present modification example. Adjacent recesses 93 have respective protrusions 94 provided therebetween, which protrude toward the shaft section 75 in a radial direction.

In the present modification example, as in the foregoing embodiment, the gap between the communication hole 64 and the shaft section 75, when viewed in the axial direction, also includes a first gap width G1, which is relatively small, and a second gap width G2, which is relatively large. During opening/closing of the pressure regulation valve 58, the position of the pressure regulation valve 58 is regulated and the pressure regulation valve 58 is guided, with respect to the valve seat, by the outer circumferential surface of the guide portion 78 and the inner circumferential surface of the communication hole 64, in other words, the protruded ends of the protrusions 94. This reduces the likelihood of the pressure regulation valve 58 inclining or being displaced with respect to the valve seat in a direction intersecting the axial direction of the pressure regulation valve 58. The gap having widths of G1 and G2 between the recesses 93 of the communication hole 64 and the guide portion 78 functions as the ink flow path. Note that the number of and the shapes of the convex and concave portions of the guide portion 78 or the communication hole 64 are not limited to those exemplified above. Both of the shaft section 75 and the communication hole 64 may have convex and concave portions provided that the pressure regulation valve 58 can be guided in an appropriate direction with respect to the valve seat.

Figure 10:
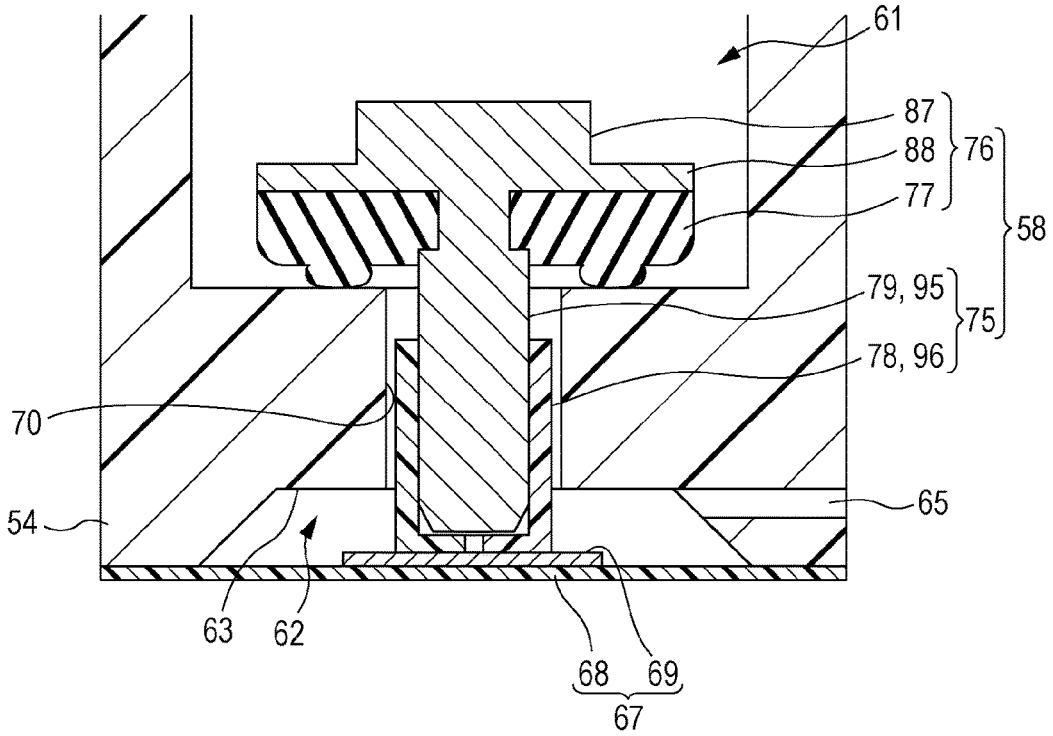
FIG. 10 is a cross-sectional view illustrating an example of a valve unit according to a second embodiment when the valve is closed.
Figure 11:
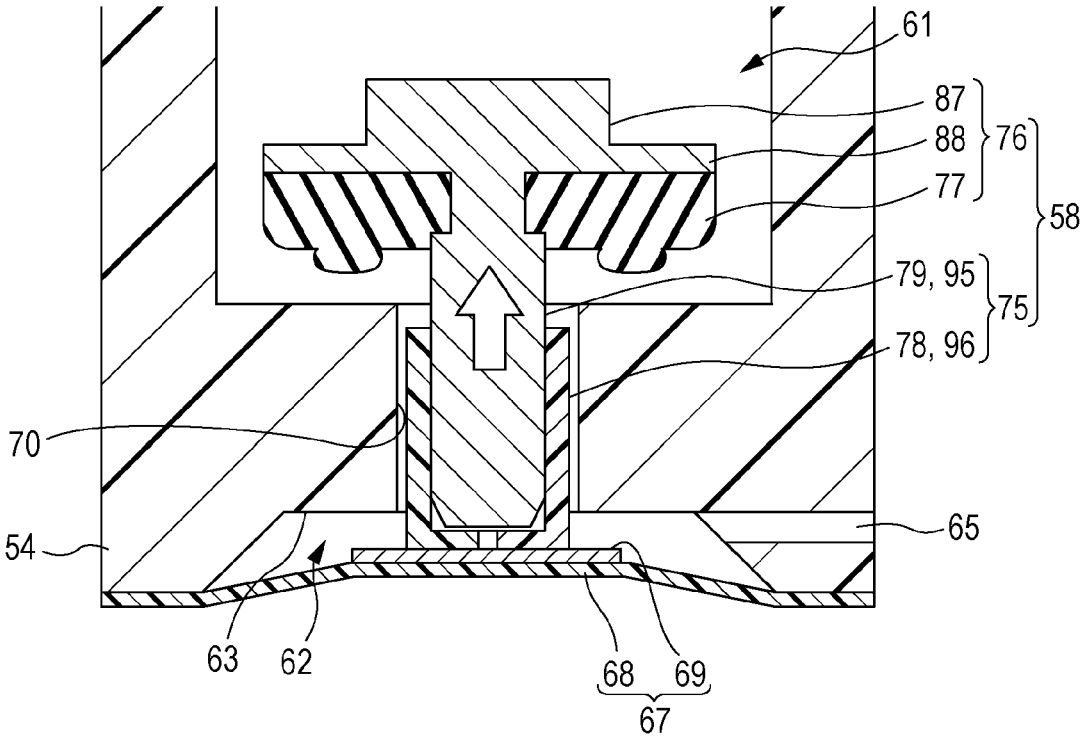
FIG. 11 is a cross-sectional view illustrating an example of a valve unit according to a second embodiment when the valve is open.

FIG. 10 and FIG. 11 are cross-sectional views schematically illustrating a valve unit 21 according to a second embodiment. The valve unit 21 is closed in FIG. 10 and is open in FIG. 11. In the valve unit 21 according to the present embodiment, the main body of the pressure regulation valve 58 (the shaft section 75, the flange portion 88, and the base portion 87) is made of a metal, such as stainless steel, for example, and is heavier than the pressure regulation valve 58 of the first embodiment, which is made of a synthetic resin. It is desirable that the pressure regulation valve 58 be made of a material having a specific gravity of 7 g/cm$^3$ or more. In addition, the valve chamber 61 is disposed on top of the pressure regulation chamber 62 with the partition wall 63 sandwiched therebetween in the vertical direction. Note that "vertical direction" as used herein does not necessarily refer to strict verticality (gravity direction) but may include directions slightly deviating from verticality. In the present embodiment, the valve unit 21 does not include the urging member 91 of the first embodiment. The pressure regulation valve 58 is urged by its own weight in a direction to close the valve, in other words, toward the partition wall 63, which serves as the valve seat.

The shaft section 75 according to the present embodiment includes a columnar portion 95 and a cover portion 96. The columnar portion 95 and the main body of the pressure regulation valve 58 are integrally formed of a metal, whereas the cover portion 96 is a separate body formed separately from the columnar portion 95. Similarly to the valve-unit body 54, the cover portion 96 is made of a synthetic resin, such as for example polypropylene (PP) or modified polyphenylene ether (modified PPE, also referred to as "Xyron®") or the like. The cover portion 96 is formed into a cylinder having a bottom. The cover portion 96 may be made of a metal instead of a synthetic resin. The inner diameter of the cover portion 96 is designed to have a diameter similar to, or slightly larger than, the outer diameter of the columnar portion 95. The cover portion 96 is designed to have an outer diameter that is larger than the inner diameter of the cover portion 96 and is slightly smaller than the inner diameter of the communication hole 64. The length (i.e., depth) of the interior space of the cover portion 96 in the axial direction is designed shorter than the total length of the columnar portion 95 in the axial direction. Accordingly, in a state in which the columnar portion 95 is inserted deep into the cover portion 96, a portion of the columnar portion 95 that is near the sealing section 76 is exposed out of the cover portion 96. In the shaft section 75 according to the present embodiment, the portion covered with the cover portion 96 functions as the guide portion 78, whereas the portion of the columnar portion 95 exposed out of the cover portion 96 functions as the small-diameter portion 79. In addition, in the present embodiment, the spacer 72 of the first embodiment is not provided. However, the liquid-repellency treatment may be applied directly to an area surrounding the opening of the communication hole 64 with which the elastic member 77 comes into contact when the valve is closed.

In the present embodiment, the small-diameter portion 79 is also provided between the guide portion 78 and the sealing section 76. This reduces the likelihood of the shaft section 75 of the pressure regulation valve 58 interfering with the valve seat during opening/closing of the valve. Even with the configuration of the present embodiment in which the spacer 72 is not provided, the likelihood of the shaft section 75 interfering with the peripheral edge surrounding the opening of the communication hole 64 is reduced. Thus, the pressure regulation valve 58 can be opened/closed smoothly. In addition, even if the material of the main body of the pressure regulation valve 58 is more rigid than that of the valve-unit body 54, the portion of the pressure regulation valve 58 that functions as the guide portion 78 is covered with the cover portion 96, of which the material is not as rigid as the main body of the pressure regulation valve 58. As a result, the pressure regulation valve 58 can be operated stably for a long period of time. In the present embodiment, it is also desirable that convex and concave portions be formed at least either in the cover portion 96 or in the communication hole 64 and thereby the gap having a first gap width, which is relatively small, and a second gap width, which is relatively large, be formed between the communication hole 64 and the shaft section 75.

In the foregoing embodiments, it has been described by way of example that the elastic member 77 is disposed on the pressure regulation valve 58. However, the pressure regulation valve 58 need not include the elastic member 77. A member corresponding to the elastic member 77 may be disposed in the valve seat (i.e., the partition wall 63) on an area surrounding the opening of the communication hole 64.

Moreover, the valve unit 21 is exemplified in the above embodiments as a member that is independent of the recording head 10. However, the valve unit 21 is not limited to this configuration. A liquid ejecting head may have the valve unit according to the invention (or an ejection mechanism may have a function corresponding to the valve unit according to the invention).

Furthermore, the valve unit is exemplified in the above embodiments as the valve unit 21 that supplies ink to the recording head 10, which is a type of liquid ejecting head. However, the valve unit is not limited to this. The valve unit according to the invention is a device in which the shaft section of a valve body is inserted in a hole that constitutes part of a flow path. Thus, the valve unit can be used in applications in which the valve unit opens/closes a flow-path hole through which various types of liquid flow. For example, the invention can be applied to a check valve, such as an umbrella valve.

What is claimed is:

1. A valve unit, comprising:

a valve seat that has a hole provided therethrough, the hole configured to serve as part of a flow path; and a valve body that is configured to move in a first direction relative to the valve seat, wherein the valve body includes a first portion that is configured to open/close the hole in collaboration with the valve seat, a second portion that is located inside the hole when viewed in the first direction, and a third portion that is located between the first portion and the second portion in the first direction and is located inside the hole while the hole is closed by the first portion, and when viewed in the first direction, a gap between the hole and the third portion is larger than a gap between the hole and the second portion.

2. The valve unit according to claim 1, wherein the first portion includes an elastic member that is configured to open/close the hole by causing the elastic member to separate from, or come into contact with, the valve seat, a retaining portion on which the elastic member is disposed, and a narrow portion that is located between the retaining portion and the third portion in the first direction.

3. The valve unit according to claim 2, wherein the narrow portion includes a portion that has a width in a second direction that intersects the first direction, the width being narrower than the third portion, and the narrow portion is surrounded by the elastic member that is mounted on the retaining portion.

4. A liquid ejecting apparatus, comprising:

a valve unit according to claim 2; and an ejection mechanism having nozzles that eject liquid supplied from the valve unit.

5. The valve unit according to claim 3, wherein the valve seat includes a hole member having the hole provided therethrough, and a contact member with which the valve body is configured to come into contact during valve closure in which the hole is closed by the valve body.

6. A liquid ejecting apparatus, comprising:

a valve unit according to claim 3; and an ejection mechanism having nozzles that eject liquid supplied from the valve unit.

7. The valve unit according to claim 5, wherein the contact member is disposed on a portion surrounding an opening of the hole in the hole member.

8. The valve unit according to claim 5, further comprising an enlarged portion at an opening of the hole of the hole member, the opening being located near the contact member, wherein the enlarged portion has an inner width that is larger than any other inner width of the hole in a second direction that intersects the first direction.

9. The valve unit according to claim 7, wherein the contact member has a portion with which the valve body is configured to come into contact, and liquid repellency of the portion is higher than liquid repellency of the hole member.

10. The valve unit according to claim 9, wherein rigidity of the contact member is higher than rigidity of the hole member.

11. The valve unit according to claim 1, wherein when viewed in the first direction, a gap between the second portion and the hole has a first width and a second width that is wider than the first width.

12. The valve unit according to claim 1, wherein the second portion has a tapered shape, at an end opposite to the first portion in the first direction, in which thickness decreases as distance from the first portion increases.

13. The valve unit according to claim 12, wherein the valve seat includes a hole member having the hole provided therethrough, and a contact member with which the valve body is configured to come into contact during valve closure in which the hole is closed by the valve body.

14. The valve unit according to claim 13, wherein the contact member is disposed on a portion surrounding an opening of the hole in the hole member.

15. The valve unit according to claim 14, wherein the contact member has a portion with which the valve body is configured to come into contact and liquid repellency of the portion is higher than liquid repellency of the hole member.

16. The valve unit according to claim 15, wherein rigidity of the contact member is higher than rigidity of the hole member.

17. A liquid ejecting apparatus, comprising:

a valve unit according to claim 1; and an ejection mechanism having nozzles that eject liquid supplied from the valve unit.

18. The valve unit according to claim 1, wherein the valve seat includes a hole member having the hole provided therethrough, and a contact member with which the valve body is configured to come into contact during valve closure in which the hole is closed by the valve body.

19. The valve unit according to claim 18, wherein the contact member has a portion with which the valve body is configured to come into contact and liquid repellency of the portion is higher than liquid repellency of the hole member.

20. The valve unit according to claim 18, wherein rigidity of the contact member is higher than rigidity of the hole member.

* * * * *